US007819939B1

(12) United States Patent
Yang et al.

(10) Patent No.: US 7,819,939 B1
(45) Date of Patent: Oct. 26, 2010

(54) SYNTHESIS OF NICKEL NANOPOWDERS

(75) Inventors: Yi Yang, Broadview Heights, OH (US); Xiangdong Feng, Upland, CA (US); Yang Xiang, Garfield Heights, OH (US)

(73) Assignee: Ferro Corporation, Cleveland, OH (US)

( * ) Notice: Subject to any disclaimer, the term of this patent is extended or adjusted under 35 U.S.C. 154(b) by 509 days.

(21) Appl. No.: 11/462,729

(22) Filed: Aug. 7, 2006

(51) Int. Cl.

| | |
|---|---|
| ***B22F 9/24*** | (2006.01) |
| ***B22F 9/18*** | (2006.01) |
| ***C22B 5/00*** | (2006.01) |
| ***C22B 23/00*** | (2006.01) |
| ***B01J 23/00*** | (2006.01) |

(52) U.S. Cl. ..... 75/374; 502/337; 423/138; 423/140

(58) Field of Classification Search ..... 75/374; 423/138–152; 502/337
See application file for complete search history.

(56) References Cited

U.S. PATENT DOCUMENTS

| | | | | |
|---|---|---|---|---|
| 4,425,469 | A * | 1/1984 | Emmons et al. | 524/750 |
| 6,120,576 | A * | 9/2000 | Toshima et al. | 75/370 |
| 6,375,703 | B1 | 4/2002 | Chou et al. | |
| 2004/0000217 | A1 * | 1/2004 | Toshima et al. | 75/374 |
| 2004/0180203 | A1 | 9/2004 | Yadav et al. | |
| 2005/0056118 | A1 | 3/2005 | Xia et al. | |
| 2006/0042416 | A1 | 3/2006 | Yoon et al. | |

OTHER PUBLICATIONS

Bibliographic Abstract for CN 1426865 published Jul. 2, 2003, one page.

Bibliographic Abstract for CN 1302709 published Jul. 11, 2001, one page.

Feng et al., "Study of Making Nickel Nano Powder by Using Hydrazine Reduction Method," Journal of Jiangsu Radio & Television Univ., vol. 15, Issue No. 6, Dec. 2004, pp. 36-41.

Wu et al., "Synthesis and characterization of nickel nanoparticles by hydrazine reduction in ethylene glycol," Journal of Colloid and Interface Science 259 (2003), pp. 282-286.

Zheng et al., "Preparation of nickel nanopowders in ethanel-water system (EWS)," Materials Research Bulletin 36 (2001) pp. 947-952.

* cited by examiner

*Primary Examiner*—David M. Brunsman
*Assistant Examiner*—Kevin M Johnson
(74) *Attorney, Agent, or Firm*—Rankin, Hill & Clark LLP

(57) ABSTRACT

The invention relates to a method of making a nickel powder having an average particle size of less than about 100 nanometers, comprising contacting, at a temperature of about 50° C. to about 95° C., a reduction solution with a nickel solution to form a reaction mixture. The reduction solution comprises a base and a reducing agent. The nickel solution comprises a nickel compound water, a nucleation agent, a surfactant or dispersant, and combinations thereof. The yield of nickel nanoparticles is greater than about 90% relative to starting moles of nickel compound. The nickel powder is suitable for use in electronics applications and sintered metal applications.

14 Claims, No Drawings

SYNTHESIS OF NICKEL NANOPOWDERS

BACKGROUND OF THE INVENTION

1. Field of Invention

This invention relates to a process of producing nanoscale nickel powders.

2. Description of Related Art

In order to achieve high yields, prior art methods of making nanometer scale ("nanoscale") nickel powders involved starting reagents in extremely low concentrations (0.1 M or less). Prior art methods beginning with reactants in higher concentrations often resulted in low yields. Given that high yields of relatively uniform particles was the goal, reaction of starting materials in low concentrations required long reaction times and/or large reaction volumes, which in turn resulted in large waste streams of solvents such as water, alcohols, or other organic solvents, all of which added expense and complexity to the production process.

Accordingly, it would be advantageous to produce nanoscale nickel particles (averaging less than about 100 nm in diameter) in relatively high concentration (initial nickel concentration up to 3 M) and in high yield (over 90% relative to starting moles of nickel source.)

BRIEF SUMMARY OF THE INVENTION

The invention relates to a method of making a nickel powder having an average panicle size of less than about 100 nanometers, comprising contacting, at a temperature of about 50° C. to about 95° C., a reduction solution with a nickel solution to form a reaction mixture. The reduction solution comprises a base providing OH ions, and a reducing agent such as hydrazine, sodium borohydride, potassium borohydride, and lithium aluminum hydride. The nickel solution comprises water, a nucleation agent, a surfactant or dispersant, or combinations thereof, and a nickel compound selected from the group consisting of nickel acetate, nickel chloride, nickel sulfate, and nickel acetylacetonate. In certain embodiments, the solvent in the nickel solution may be water alone, devoid of other solvents. The nickel solution may alternatively comprise absolute alcohol as a solvent, and be devoid of water. Blends of water and one or more alcohols are also suitable as solvents.

Another embodiment of the invention involves a method of making a nickel powder having an average particle size of less than about 100 nanometers, comprising contacting, at a temperature of about 50° C. to about 95° C., a reduction solution with a nickel solution to form a reaction mixture. The reduction solution comprises a base providing OH ions, and a reducing agent such as hydrazine, sodium borohydride, potassium borohydride, and lithium aluminum hydride. The nickel solution excludes water and comprises absolute alcohol, a surfactant or dispersant, a nucleation agent, and a nickel compound such as nickel acetate, nickel chloride, nickel sulfate, and nickel acetylacetonate, and combinations thereof.

DETAILED DESCRIPTION OF THE INVENTION

The invention involves a method of making a nickel powder having an average particle size of less than about 100 nanometers, comprising contacting, at a temperature of about 50° C. to about 95° C., a reduction solution with a nickel solution to form a reaction mixture, wherein the reduction solution comprises a base providing OH ions, and a reducing agent selected from the group consisting of hydrazine, sodium borohydride, potassium borohydride, lithium aluminum hydride, and wherein the nickel solution comprises water, a nucleation agent, a surfactant or dispersant, or combinations thereof, and a nickel compound selected from the group consisting of nickel acetate, nickel chloride, nickel sulfate, and nickel acetylacetonate. The nickel solution may alternatively comprise absolute alcohol as a solvent, and be devoid of water.

Based on the reaction methods disclosed herein, the resultant yield of nickel nanoparticles can exceed about 90% relative to starting moles of nickel salt. Preferably the nickel nanoparticle yield is greater than about 95% and more preferably greater than about 99%. As stated, the inventive method involves a reduction solution and a nickel solution. The details of each, as well as reaction conditions, are set forth hereinbelow.

Reduction Solution: The reduction solution includes a reducing agent and a base. The reducing agent donates electrons to reduce Ni(II) to Ni(0). Useful reducing agents include hydrazine, sodium borohydride, potassium borohydride, and lithium aluminum hydride. When developing the reactions disclosed herein, the inventors have discovered that a molar excess of reducing agent relative to nickel is desirable. The reaction mixture advantageously contains reducing agent and Ni ions in a molar ratio of about 1.5:1 to about 8:1, preferably about 2:1 to about 7:1, and more preferably about 3:1 to about 6:1.

The base may be any strong Brønsted base that provides OH ions to the reaction mixture and may include one or more of the following: KOH, NaOH, $Na_2CO_3$, $NaHCO_3$, and $NH_4OH$. Combinations of such bases may also be used, and other Brønsted bases known in the art may be used. The concentration of the base in the reduction solution is typically in the range of about 4 M to about 10 M, preferably about 4 M to about 8 M. The concentration of base is provided such that the reaction mixture contains OH ions and Ni ions in a molar ratio of about 1 to about 3, preferably about 1.5 to about 2.

Nickel solution. The nickel solution comprises a nickel compound in a concentration of about 0.1 to about 3 M, preferably about 0.4 to about 2 M, and more preferably about 0.5 to about 1.5 M. The nickel solution is typically aqueous, in order to solvate Ni(II) ions from the nickel compound, which is usually an ionic salt. The nickel compound may be selected from nickel acetate, nickel chloride, nickel sulfate, and nickel acetylacetonate. Preferably, the nickel compound is selected from nickel acetate, nickel sulfate, or nickel chloride. More preferably, the nickel compound is nickel acetate or nickel sulfate. The solvent may alternatively comprise at least one alcohol or glycol in addition to water. Finally, the solvent may comprise absolute alcohol, and be devoid of water.

The nickel solution may alternatively comprise a slightly soluble or insoluble nickel compound. In such case, the nickel solution is more aptly termed a slurry. However, for the purposes of the specification and claims herein, in the broadest sense, the phrase "nickel solution" contemplates both a solution as traditionally defined and a slurry.

Surfactant or Dispersant. The nickel solution typically includes a surfactant or dispersant, or both. Commercially available dispersants and surfactants sold by Noveon Performance Coatings of Cleveland, Ohio under the Solsperse® trademark as well as those sold by Sigma Aldrich of St. Louis, Mo., under the Brij® trademark (e.g., Brij® 56 and Brij® 58) are suitable. Generally, suitable surfactants and dispersants include polyacrylamide, polyvinylpyrrolidone, polyacrylic acid, sodium polyacrylate, polyethylene glycol, polyethyleneimine, sodium dodecyl sulfate, stearic acid, ethoxylated ethers, ethoxylated alkyl phenols, ethoxylated aryl phenols, ethoxylated sorbitan fatty acid esters, polyoxyethylene sorbitan monolaurate, polyoxyethylene sorbitan monopalmitate, polyoxyethylene sorbitan monostearate, polyoxyethylene sorbitan tristearate, polyoxyethylene sorbitan monooleate, polyoxyethylene sorbitan trioleate, gum arabic and polyoxyethylene alcohols having a formula represented by $C_mH_{2m+1}(OCH_2CH_2)_nOH$, where m is 8 to 18 and n is 10 to 100. Examples of the latter include Brij® 56 (where m is 16 and n is about 10) and Brij® 58 (where m is 16 and n is about 20). Polyacrylamide is preferred.

Nucleation agent. The nickel solution may include a nucleation agent selected from the group consisting of $PdCl_2$, $AgNO_3$, and $K_2PtCl_4$ such that the mole ratio of nucleation agent to nickel is about 1:10000 to about 1:100. Preferably, the mole ratio of nucleation agent to nickel is about 1:2000 to about 1:100, more preferably, about 1:1000 to about 1:200, still more preferably, about 1:500 to about 1:200.

Optional alcohol or glycol. Although the reduction reaction disclosed herein may be conducted in aqueous solution absent alcohol, solvent blends of alcohol and water are also envisioned. Suitable alcohols include $C_1$-$C_{15}$ aliphatic alcohols, $C_6$-$C_{30}$ aromatic alcohols, $C_2$-$C_{30}$ glycols, and combinations thereof. For example, methanol, ethanol, isopropanol, ethylene glycol, and propylene glycol, and combinations thereof are suitable. When both water and alcohol are present in the nickel solution, their volume ratio may be about 1:20 to about 20:1, preferably about 1:10 to about 10:1, more preferably about 1:5 to about 5:1.

Reaction. The reaction temperature is typically moderate, under about 100° C., preferably about 50° C. to about 95° C., more preferably about 60° C. to about 90° C. The overall reaction mixture may be formed by pouring the reduction solution into a container already containing the nickel salt solution. Alternatively, the reduction solution and nickel salt solution may be added simultaneously to a reaction vessel, such as by double-injection. The goal of the invention is to produce nanoscale nickel metal particles having an average size of less than about 100 nanometers. In certain embodiments, the reactions disclosed herein can produce nickel particles having an average size of less than about 70 nanometers, less than about 50 nanometers, and even less than about 30 nanometers.

The nickel nanoparticles made by the procedures detailed herein are suitable for use in a variety of applications, including, without limitation, catalysts, fuel cells, sintered metal applications, and conductive pastes and inks for use in electronics applications including multilayer ceramic chip (MLCC) capacitors, radio frequency identification (RFID) devices, integrated circuits, electrodes, and storage batteries.

EXAMPLES

The following examples are intended only to illustrate the invention and should not be construed as imposing limitations upon the claims.

Example 1

A reduction solution was prepared by dissolving 10.03 g of 85% potassium hydroxide into 24.51 g of 98% hydrazine monohydrate. The solution, having a volume of 34 mL, was stirred for 20 minutes.

A nickel salt solution was prepared by dissolving 20.32 g of 98% nickel acetate tetrahydrate (Aldrich) and 0.94 g of 50% polyacrylamide (PAAm, MW=10000, Aldrich) solution into 66 mL of a mixed solvent of ethanol and water at a ratio of 30:70 (volume). The nickel salt solution was stirred for 20 minutes.

The final reaction mixture (100 mL) was obtained by adding the reduction solution quickly into the nickel salt solution in a 500 ml flask. The color of the solution turned from green into deep blue immediately and the temperature rose from room temperature to 40° C. The flask was immediately dipped into an 80° C. water bath. The solution finally turned to black, indicating formation of nickel nanoparticles. After 30 minutes from the mixing event of the two solutions, the reaction was stopped. Nickel nanoparticles were subsequently filtered out, followed by washing in turn with DI water, ethanol, and acetone. The product was dried in nitrogen gas to obtain a powder. The average nickel particle size was 92 nm as measured by transmission electron microscopy.

Examples 2-15

Further exemplary reaction mixtures were formulated according to the ingredients and parameters set forth in Table 1 according to the procedures of Example 1 with a few exceptions. While typically, the base was KOH and the surfactant was PAAm, in Example 5, Brij 56 was used as the surfactant, and NaOH was the base. In Example 8, NaOH was used as the base. In Example 13, the surfactant was gum arabic. For those examples having a solution volume other than 100 mL, the reduction solution and the nickel salt solution were added to a 5 liter reaction vessel simultaneously by double injection. In all examples where the mixed $EtOH/H_2O$ solvent was used, the volume ratio was $3EtOH:7H_2O$. EG is ethylene glycol. The particles were either spherical or spiky as known in the art. The yield of nickel relative to moles of starting nickel salt was calculated for two examples: In Example 10, the yield was 99.75%; in Example 11, the yield was 99.84%.

TABLE 1

Nickel Particle Formation Reaction parameters and nickel particle properties.

| ID | Nickel Salt | Moles Nickel | Pd/Ni (mol %) | Surfactant (g) (PAAm) | $N_2H_4$ content (mol) | KOH content (mol) | Solvent | Reaction Temp (° C.) | Reaction time (min) | Shape | TEM (nm) | Solution volume (ml) |
|---|---|---|---|---|---|---|---|---|---|---|---|---|
| 1 | $Ni(Ac)_2$ | 0.08 | 0 | 0.94 | 0.48 | 0.152 | EtOH + $H_2O$ | 80 | 30 | spiky | 92 | 100 |
| 2 | $Ni(Ac)_2$ | 0.1 | 0.05 | 0.59 | 0.6 | 0.19 | $H_2O$ | 80 | 30 | spiky | 65 | 100 |
| 3 | $Ni(Ac)_2$ | 0.1 | 0.2 | 3.17 | 0.6 | 0.19 | $H_2O$ | 80 | 30 | spiky | 42 | 100 |
| 4 | $Ni(Ac)_2$ | 0.08 | 0.4 | 0.47 | 0.48 | 0.152 | EtOH + $H_2O$ | 80 | 30 | spiky | 27 | 100 |
| 5 | $NiSO_4$ | 0.08 | 0.4 | 0.39 (Brij56) | 0.24 | 0.16 (NaOH) | $H_2O$ | 60 | 10 | spherical | 21 | 100 |
| 6 | $NiSO_4$ | 0.08 | 0.4 | 1.88 | 0.48 | 0.152 | EtOH + H2O | 80 | 10 | spherical | 16 | 100 |

TABLE 1-continued

Nickel Particle Formation Reaction parameters and nickel particle properties.

| ID | Nickel Salt | Moles Nickel | Pd/Ni (mol %) | Surfactant (g) (PAAm) | $N_2H_4$ content (mol) | KOH content (mol) | Solvent | Reaction Temp (° C.) | Reaction time (min) | Shape | TEM (nm) | Solution volume (ml) |
|---|---|---|---|---|---|---|---|---|---|---|---|---|
| 7 | $NiSO_4$ | 0.02 | 0 | 0 | 0.12 | 0.04 | EG | 60 | 28 | spherical | 9.9 | 100 |
| 8 | $NiSO_4$ | 0.8 | 0.4 | 18.79 | 1.6 | 1.6 (NaOH) | $H_2O$ | 80 | 10 | spherical | 16 | 950 |
| 9 | $NiSO_4$ | 0.8 | 0.4 | 46.97 | 2.4 | 1.2 | $H_2O$ | 60 | 12 | spherical | 23 | 930 |
| 10 | $NiSO_4$ | 0.8 | 0.4 | 46.98 | 2.4 | 1.52 | $H_2O$ | 60 | 7.5 | spherical | 19 | 950 |
| 11 | $NiSO_4$ | 0.8 | 0.4 | 46.98 | 1.6 | 1.52 | $H_2O$ | 60 | 7 | spherical | 27 | 950 |
| 12 | $NiSO_4$ | 0.8 | 0.1 | 46.97 | 2.4 | 1.52 | $H_2O$ | 60 | 9 | spherical | 36 | 950 |
| 13 | $NiSO_4$ | 0.8 | 0.3 | 4.7 (Gum Arabic) | 4.8 | 1.52 | $H_2O$ | 80 | 11 | spherical | 25 | 1250 |

What is claimed is:

1. A method of making a nickel powder having an average particle size of less than 100 nanometers, comprising contacting, at a temperature of about 50° C. to about 95° C., a reduction solution with a nickel solution to form a reaction mixture and initiate a reaction, a. wherein the reduction solution comprises i. a base providing OH ions, and ii. a reducing agent selected from the group consisting of hydrazine, sodium borohydride, potassium borohydride, lithium aluminum hydride, b. wherein the nickel solution excludes alcohol and glycol and comprises i. water, ii. a nucleation agent, iii. a surfactant selected from the group consisting of polyacrylamide, $C_{16}H_{33}(OCH_2CH_2)OH$, and gum arabic, iv. a nickel compound selected from the group consisting of nickel acetate, nickel chloride, nickel sulfate, and nickel acetylacetonate said nickel compound providing nickel ions to the nickel solution at a concentration of from 0.5 to 1.5 M, c. wherein the mole ratio of OH ions to nickel ions is 1:1 to 2.5:1, d. wherein the mole ratio of reducing agent to nickel ions is from 1.5:1 to 8:1, and e. wherein the reaction runs to completion in no greater than 30 minutes.

2. The method of claim 1 wherein the base is selected from the group consisting of KOH, NaOH, $Na_2CO_3$, $NaHCO_3$, and $NH_4OH$, and combinations thereof.

3. The method of claim 1 wherein the nickel solution further comprises a nucleation agent selected from the group consisting of PdC12, $AgNO_3$, and $K_2PtCl_4$ such that the mole ratio of nucleation agent to nickel is about 1:10000 to about 1:100.

4. The method of claim 1 wherein the average particle size does not exceed about 70 nm, wherein the temperature is about 60° C. to about 90° C., wherein the nickel compound is nickel acetate or nickel sulfate or nickel chloride, and wherein the mole ratio of nucleation agent to nickel is about 1:2000 to about 1:100.

5. The method of claim 1, wherein the mole ratio of OH ions to nickel ions is from 1.5:1 to 2:1.

6. The method of claim 1, wherein the mole ratio of reducing agent to nickel ions is from 2:1 to 7:1.

7. The method of claim 1, wherein the mole ratio of reducing agent to nickel ions is from 3:1 to 6:1.

8. The method of claim 6, wherein the mole ratio of OH ions to nickel ions is from 1.5:1 to 2:1.

9. The method of claim 7, wherein the mole ratio of OH ions to nickel ions is from 1.5:1 to 2:1.

10. The method of claim 1, wherein the yield of nickel powder is greater than 95% relative to starting moles of nickel.

11. The method of claim 1, wherein the nickel powder having an average particle size of less than 70 nanometers.

12. The method of claim 1, wherein the nickel compound provides nickel ions to the nickel solution at a concentration of from 0.606 to 1.5 M.

13. The method of claim 1, wherein the nickel compound provides nickel ions to the nickel solution at a concentration of from 0.67 to 1.5 M.

14. The method of claim 1, wherein the nickel compound provides nickel ions to the nickel solution at a concentration of from 1 to 1.5 M.

* * * * *